US011478083B1

(12) United States Patent
Li et al.

(10) Patent No.: US 11,478,083 B1
(45) Date of Patent: Oct. 25, 2022

(54) SOFA BACKREST ADJUSTING APPARATUS WITH INTEGRATED HEADREST AND LUMBAR CUSHION

(71) Applicant: DewertOkin Technology Group Co., Ltd., Zhejiang (CN)

(72) Inventors: Long Li, Zhejiang (CN); Bin Shen, Zhejiang (CN); Pengfei He, Zhejiang (CN); Minglong Lei, Zhejiang (CN); Kangming Tao, Zhejiang (CN); Guangjiao Zhang, Zhejiang (CN)

(73) Assignee: DewertOkin Technology Group Co., Ltd., Jiaxing (CN)

( * ) Notice: Subject to any disclaimer, the term of this patent is extended or adjusted under 35 U.S.C. 154(b) by 0 days.

(21) Appl. No.: 17/462,346

(22) Filed: Aug. 31, 2021

(51) Int. Cl.

| | |
|---|---|
| ***B60N 2/02*** | (2006.01) |
| ***B60N 2/66*** | (2006.01) |
| ***A47C 1/02*** | (2006.01) |
| ***A47C 7/46*** | (2006.01) |
| ***A47C 7/38*** | (2006.01) |
| ***A47C 17/04*** | (2006.01) |

(52) U.S. Cl.
CPC ..... *A47C 7/462* (2013.01); *A47C 7/38* (2013.01); *A47C 17/04* (2013.01)

(58) Field of Classification Search
CPC ..... B60N 2/0232; B60N 2/02; B60N 2/233; B60N 2/806; A47C 1/022; A47C 1/0242; A47C 1/036
See application file for complete search history.

(56) References Cited

U.S. PATENT DOCUMENTS

| | | | | |
|---|---|---|---|---|
| 5,098,158 | A * | 3/1992 | Palarski | A47C 7/506 297/312 |
| 11,377,007 | B2 * | 7/2022 | Samain | B60N 2/853 |
| 2010/0102605 | A1 * | 4/2010 | Yamada | B60N 2/2222 297/284.3 |
| 2020/0282865 | A1 * | 9/2020 | Samain | B60N 2/62 |

FOREIGN PATENT DOCUMENTS

| | | |
|---|---|---|
| CN | 207506260 U | 6/2018 |

* cited by examiner

*Primary Examiner* — Shin H Kim

(57) ABSTRACT

The present application relates to a sofa backrest adjusting apparatus with integrated headrest and lumbar cushion, which comprises a frame body arranged in a sofa cover, wherein a support rod is arranged in the middle of the frame body, a bearing support frame is arranged on the support rod, and a headrest driving mechanism and a lumbar cushion driving mechanism are arranged on the bearing support frame; the headrest driving mechanism comprises a first power module and a first transmission lead screw, the lumbar cushion driving mechanism comprises a second power module and a second transmission lead screw. According to the present application, when the first transmission lead screw and the second transmission lead screw are broken, only the second transmission lead screw needs to be replaced, so that the maintenance cost of the electric sofa can be reduced.

9 Claims, 5 Drawing Sheets

SOFA BACKREST ADJUSTING APPARATUS WITH INTEGRATED HEADREST AND LUMBAR CUSHION

STATEMENT REGARDING PRIOR DISCLOSURES BY AN INVENTOR OR JOINT INVENTOR

The contents of Chinese Patent Application No. 202020400819.8 filed on Mar. 25, 2020 and published on Nov. 27, 2020, is a grace period disclosure and shall not be prior art to claimed invention.

TECHNICAL FIELD

The present application relates to the field of electric sofa, in particular to a sofa backrest adjusting apparatus with integrated headrest and lumbar cushion.

BACKGROUND ART

At present, many high-end sofas or seats have adjustable lumbar cushions and headrests, and users can adjust the support of the head and the lumbar according to individual differences and real-time requirements of human bodies so as to have a high-quality rest.

A utility model with the publication number CN 207506260 U discloses a sofa backrest support, wherein a lumbar supporting mechanism and a head supporting mechanism are arranged on the sofa backrest support; the lumbar supporting mechanism comprises a lumbar support, a lumbar back plate and a first driving device; the head supporting mechanism comprises a headrest support and a second driving device; a mounting piece is fixed on the back of the lumbar supporting plate, the mounting piece is hinged on the lumbar support through a connecting shaft, an arc-shaped limiting hole is formed in the lumbar support, the circle center of the arc-shaped limiting hole is positioned on the central axis of the connecting shaft, a limiting rod is fixed on the lumbar support at a position corresponding to the arc-shaped limiting hole, and the limiting rod is matched with the arc-shaped limiting hole to limit a swinging angle of the lumbar supporting plate relative to the lumbar support. According to the utility model, the positions of the headrest support and the lumbar supporting plate are adjustable, and when the back of a human body leans on the lumbar supporting plate in the use process, the lumbar supporting plate can achieve self-adaptive angle adjustment within a certain angle range, so that the back of the human body is guaranteed to have a larger supporting surface all the time, and the comfort is improved.

In the related art, the first driving device and the second driving device are both push rod motors which belong to precision instruments and are complex in structure, and the push rod motors usually comprise lead screws. At present, a sofa manufacturer usually purchases a finished push rod motor for use, and when the lead screw is worn to be broken for a long time, the push rod motor is difficult to maintain, so that the whole push rod motor needs to be replaced, and the maintenance cost of the electric sofa is too high.

SUMMARY

In order to reduce the maintenance cost of the electric sofa, the present application provides a sofa backrest adjusting apparatus with integrated headrest and lumbar cushion.

The present application provides a sofa backrest adjusting apparatus with integrated headrest and lumbar cushion, for which the following technical solution is adopted:

a sofa backrest adjusting apparatus with integrated headrest and lumbar cushion comprises a frame body arranged in a sofa cover, wherein, a support rod is fixedly arranged in a middle part of the frame body, and a bearing support frame is fixedly arranged on the support rod along a direction parallel to a length of the frame body;

one end of the bearing support frame is rotatably connected with a headrest mechanism, a headrest driving mechanism is rotatably connected on the bearing support frame close to the headrest mechanism, the headrest driving mechanism comprises a first power module that is detachably connected with a first transmission lead screw, one end of the first transmission lead screw is connected with the headrest mechanism; when the first transmission lead screw is driven by the first power module to rotate and move along an axial direction of the first transmission lead screw, the headrest mechanism is driven to rotate to adjust an angle of supporting for head;

a lumbar cushion mechanism is rotatably connected with a middle part of the bearing support frame, the lumbar cushion mechanism extends away from the headrest mechanism, an end of the bearing support frame, which is away from the headrest mechanism, is rotatably connected with a lumbar cushion driving mechanism; the lumbar cushion driving mechanism comprises a second power module that is detachably connected with a second transmission lead screw, and one end of the second transmission lead screw is connected with the lumbar cushion mechanism; when the second transmission lead screw is driven by the second power module to rotate and move along an axial direction of the second transmission lead screw, the lumbar cushion mechanism is driven to rotate to adjust support for lumbar.

By adopting the technical solution, a large accommodating space is formed in the middle of the frame body, maintenance operation is facilitated, the first transmission lead screw is detachably connected with the first power module, the second transmission lead screw is detachably connected with the second power module, when the first transmission lead screw and the second transmission lead screw are worn to be broken, the first transmission lead screw and the second transmission lead screw only need to be disassembled and replaced, and maintenance cost of the electric sofa is reduced.

Optionally, the frame body comprises two supporting plates arranged in parallel, the bearing support frame comprises two bearing plates that are oppositely arranged and fixedly connected with each other, and surfaces of the bearing plates are parallel to surfaces of the supporting plates.

Optionally, the headrest mechanism comprises two first connecting plates that are oppositely arranged and fixedly connected with each other, and middle parts of the two first connecting plates are correspondingly rotatably connected with ends of the two bearing plates that are far away from the lumbar cushion mechanism, ends of the two first connecting plates, which are far away from the lumbar cushion mechanism, are fixedly provided with a head supporting plate;

the first power module comprises a first transmission unit rotatably arranged between the two bearing plates, the first transmission unit is connected in a transmission manner with a first driving unit, the first transmission lead screw penetrates through the first transmission unit, the end of the first transmission lead screw, which is close to the headrest mechanism, is rotatably connected with a first connecting seat, and the first connecting seat is rotatably connected with the end of the first connecting plate, which is close to the support rod; when the first transmission lead screw is driven by the first driving unit and the first transmission unit to rotate and move along the axial direction, the headrest mechanism is driven to rotate.

By adopting the technical solution, the head support angle of the headrest mechanism can be adjusted.

Optionally, the first transmission unit comprises a first housing body rotatably connected to the bearing plate;

a first worm and a first worm wheel, which are engaged with each other, are arranged in the first housing body, the first worm is connected in a transmission manner with the first driving unit, a first threaded hole is formed in center of the first worm wheel, and the first transmission lead screw penetrates through the first housing body and is matched with the first threaded hole.

By adopting the technical solution, the first transmission unit can drive the first transmission lead screw to rotate under the power action of the first driving unit, and enables the first transmission lead screw to move along the axial direction of the first transmission lead screw, so that the headrest mechanism can be pushed or pulled to rotate.

Optionally, an arc-shaped hole is formed in one end of the first connecting plate close to the lumbar cushion mechanism, and a circle center of the arc-shaped hole coincides with an axis at which the first connecting plate is rotatably connected with the bearing plate, the first connecting seat is able to slide along the arc-shaped hole;

each of the two first connecting plates is provided with a limiting rod close to the arc-shaped hole, the two limiting rods extend away from each other, and the limiting rods is able to limit a relative rotation angle between the first connecting plate and the bearing plate; one tension rod is arranged on each of the two bearing plates, and the two tension rods extend away from each other;

a spring is connected between a limiting rod and a tension rod on the same side, and the spring tensions the limiting rod and the tension rod.

By adopting the technical solution, the limiting rod can limit a relative rotation angle between the first connecting plate and the bearing plate and prevent same from being damaged due to excessive rotation. Meanwhile, in the resetting process of the headrest mechanism, when a hand of a user or other person is clamped between the headrest mechanism and the frame body, due to the existence of the arc-shaped hole, the headrest mechanism still has a relatively movable gap relative to the bearing plate and the frame body, so that the hand is prevented from being injured; due to the tensioning effect of the spring, the headrest mechanism can keep a relatively stable state, and random shaking is reduced.

Optionally, the lumbar cushion mechanism comprises two second connecting plates which are oppositely arranged and fixedly connected with each other, and ends of the two second connecting plates, which are close to the headrest mechanism, are correspondingly rotatably connected with middle parts of the two bearing plates, and ends of the two second connecting plates, which are far away from the headrest mechanism, are provided with a lumbar supporting plate;

the second power module comprises a second transmission unit rotatably arranged between the two bearing plates, the second transmission unit is connected in a transmission manner with a second driving unit, and the second transmission lead screw penetrates through the second transmission unit; an end of the second transmission lead screw, which are close to the lumbar cushion mechanism, is rotatably connected with a second connecting seat, and the second connecting seat is rotatably connected with a position of the second connecting plate close to the lumbar supporting plate; when the second transmission lead screw is driven by the second driving unit and the second transmission unit to rotate and move along an axial direction of the second transmission lead screw, the lumbar cushion mechanism is driven to rotate.

By adopting the technical solution, the lumbar support angle can be adjusted by the lumbar cushion mechanism.

Optionally, the second transmission unit comprises a second housing body rotatably connected to the bearing plate;

a second worm and a second worm wheel, which are engaged with each other, are arranged in the second housing body, the second worm is connected in a transmission manner with the second driving unit, a second threaded hole is formed in center of the second worm wheel, and the second transmission lead screw penetrates through the second housing body and is matched with the second threaded hole.

By adopting the technical solution, the second transmission unit can drive the second transmission lead screw to rotate under the power action of the second driving unit, and enables the second transmission lead screw to move along the axial direction of the second transmission lead screw, so that the lumbar cushion mechanism can be pushed or pulled to rotate.

Optionally, the lumbar supporting plate is rotatably connected to the second connecting plate, and an axis at which the lumbar supporting plate is rotatably connected to the second connecting plate parallel to the support rod.

By adopting the technical solution, after the lumbar supporting plate is lifted, the lumbar supporting plate can rotate so as to be attached to the lumbar, and the comfort is improved.

Optionally, an end of the first transmission lead screw, which is far from the headrest mechanism, is provided with a first limiting nut, and the end of the second transmission lead screw, which is far from the lumbar cushion mechanism, is provided with a second limiting nut.

By adopting the technical solution, the first transmission lead screw and the second transmission lead screw can be prevented from escaping when rotating.

In summary, the present application has at least one of the following technical effects:

1. the first transmission lead screw is detachably connected with the first power module, the second transmission lead screw is detachably connected with the second power module, when the first transmission lead screw and the second transmission lead screw are worn to be broken, the first transmission lead screw and the second transmission lead screw only need to be disassembled and replaced, other parts do not need to be replaced, and the maintenance cost of the electric sofa is reduced;

2. the first transmission unit and the second transmission unit are matched with the worm gear and the worm to drive the corresponding transmission lead screw to rotate, so that the position adjustment process of the headrest mechanism and the lumbar cushion mechanism is smoother, and the noise of the electric sofa during adjustment is reduced.

DETAILED DESCRIPTION

This application is described in further detail below with reference to FIGS. 1-4.

Figure 1:
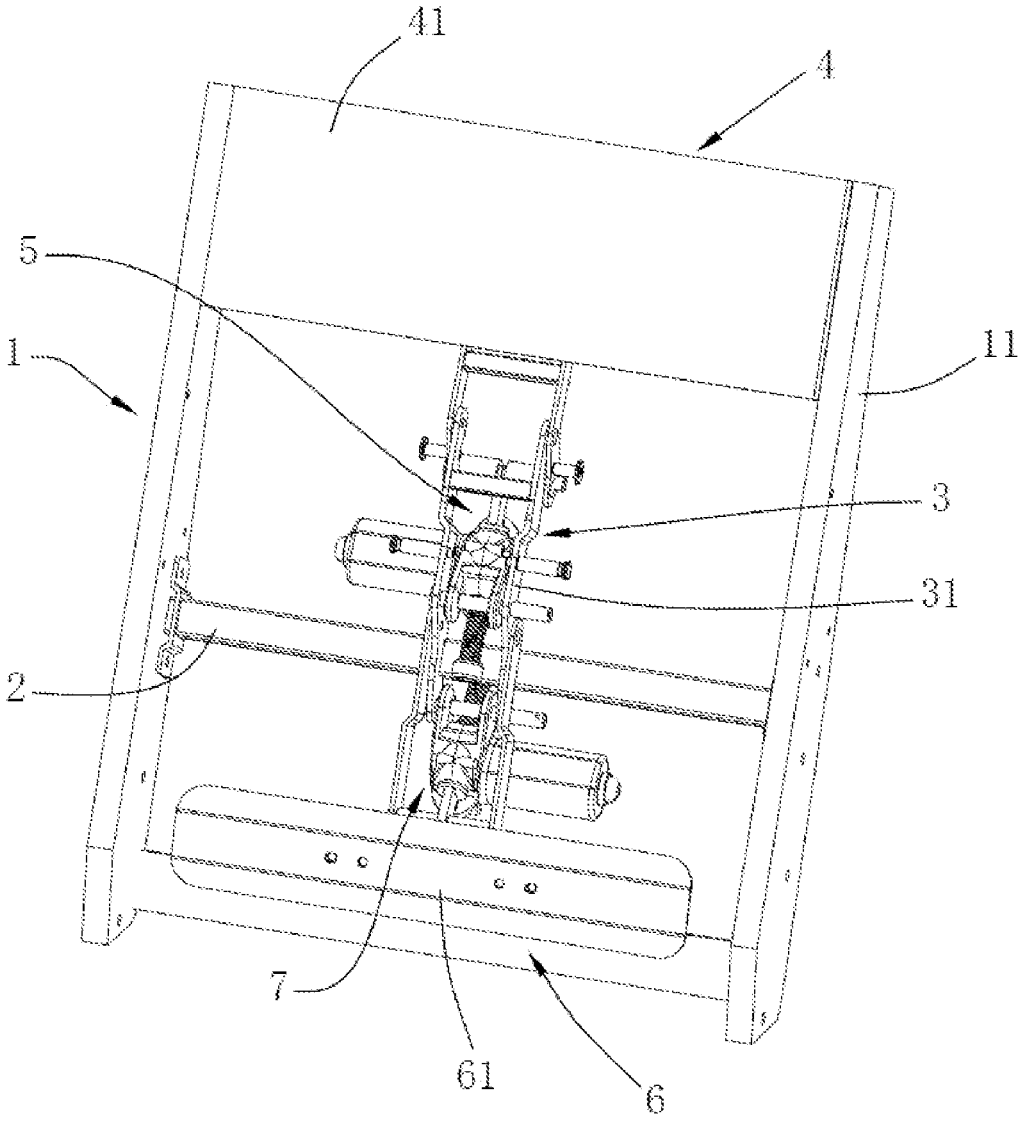
FIG. 1 is a schematic three-dimensional structure diagram according to the present application.

Referring to FIG. 1, according to an embodiment of the present application, a sofa backrest adjusting apparatus with integrated headrest and lumbar cushion includes a frame body 1 arranged in a sofa cover, wherein a support rod 2 is arranged at the middle part of the frame body 1, and a bearing support frame 3 is fixedly arranged on the support rod 2 along a length direction of the frame body 1. A headrest mechanism 4, a headrest driving mechanism 5, a lumbar cushion mechanism 6 and a lumbar cushion driving mechanism 7 are arranged on the bearing support frame 3. The headrest driving mechanism 5 is configured for driving the headrest mechanism 4 to rotate so as to adjust the support angle for the human head, and the lumbar cushion driving mechanism 7 is configured for driving the lumbar cushion mechanism 6 to rotate so as to adjust the support angle of the human lumbar.

In particular, the frame body 1 includes two supporting plates 11 which are arranged in parallel. The support rod 2 is arranged to be perpendicular to and fixedly connected with the two supporting plates 11 at the middle parts of the two supporting plates 11. The bearing support frame 3 is fixedly mounted on the support rod 2, and the bearing support frame 3 is parallel to the supporting plates 11 and extends to two sides of the support rod 2. A groove matched with the support rod 2 is formed at the middle part of the bearing support frame 3 on a side facing to the support rod 2, so that the stability of matching with the support rod 2 can be improved.

The support rod 2 may have a rod or a tubular structure, the cross-section of which may be square or circular. In this embodiment, the support rod 2 has a square tubular structure. In such way, the weight of the device can be reduced, and the stability of connection with the bearing support frame 3 can be improved.

Referring to FIG. 1, the bearing support frame 3 includes two bearing plates 31 arranged symmetrically at a distance from each other. The two bearing plates 31 are connected with each other via connecting rods to improve the structure stability of the bearing support frame 3 itself.

Figure 2:
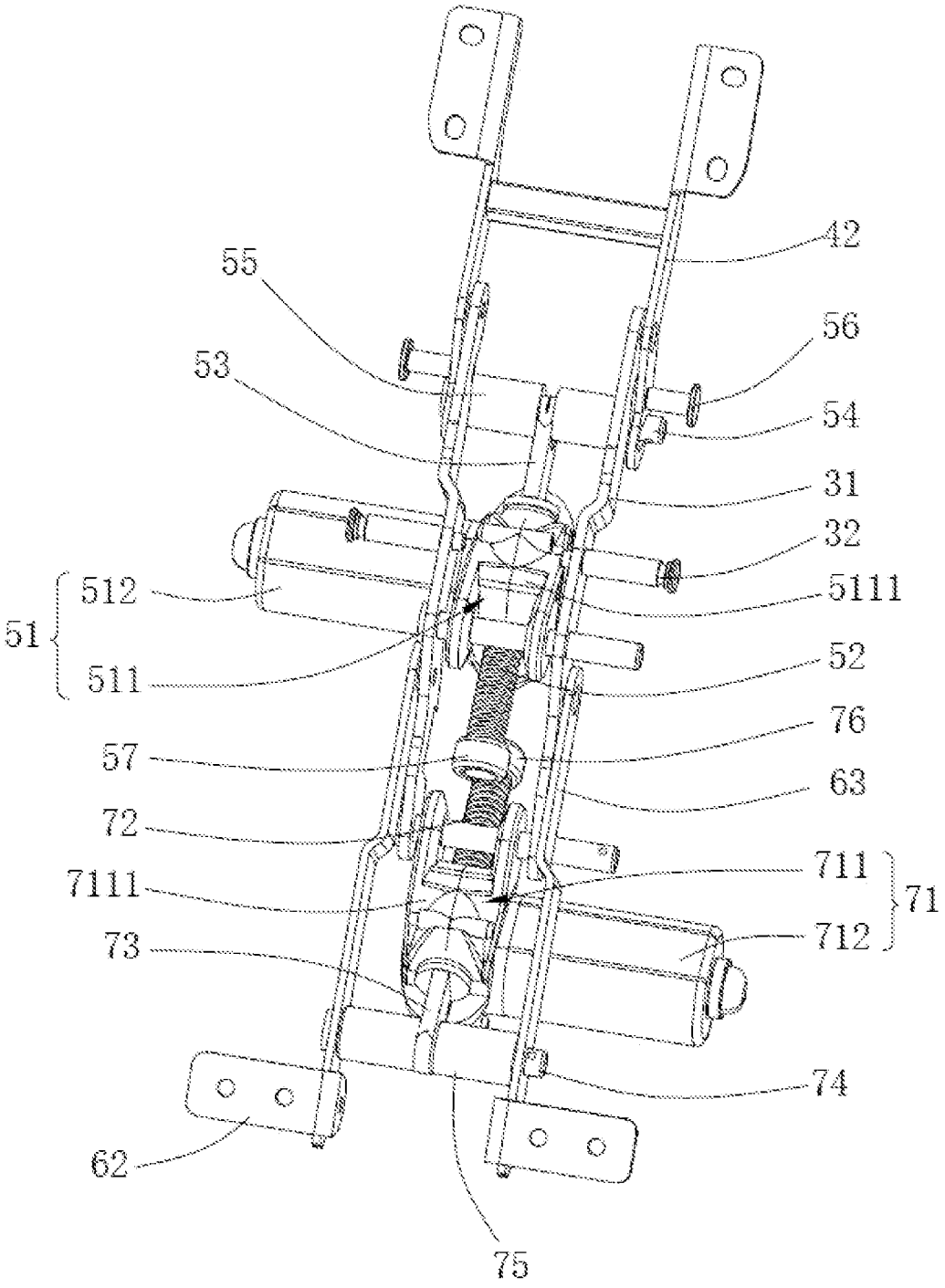
FIG. 2 is a schematic three-dimensional structure diagram according to the present application without showing the head supporting plate, the lumbar supporting plate, the frame body and the support rod.

Referring to FIGS. 1 and 2, a headrest mechanism 4 is rotatably connected to one end of the bearing support frame 3. The headrest mechanism 4 includes a head supporting plate 41 that is arranged at one side of the frame body 1. Two first connecting plates 42 are fixedly arranged on an inner surface of the head supporting plate 41 that is close to the frame body 1. The two first connecting plates 42 are oppositely arranged, and the middle parts of the two first connecting plates 42 are hinged with ends of the two bearing plates 31 correspondingly. The ends of the two first connecting plates 42, which are away from the head supporting plate 41, are rotatably connected to a headrest driving mechanism 5.

The headrest driving mechanism 5 includes a first power module 51 and a first transmission lead screw 52 that is detachably connected to the first power module 51.

The first power module 51 includes a first transmission unit 511 rotatably arranged between the two bearing plates 31, wherein the first transmission unit 511 is connected in a transmission manner with a first driving unit 512, and a first transmission lead screw 52 penetrates through the first transmission unit 511 and is connected in a transmission manner with the first transmission unit 511.

A first connecting seat 53 is rotatably connected to one end of the first transmission lead screw 52 that is close to the headrest mechanism 4. A first pin rod 54 penetrates through the first connecting seat 53. The first pin rod 54 can penetrate through the ends of the two first connecting plates 42 at the same time. When the first transmission lead screw 52 is driven by the first driving unit 511 to rotate and move in its own axial direction, the headrest mechanism 4 can be pulled or pushed to rotate by the first pin rod 54 to adjust the angle of support for the head.

A first sleeve 55 is arranged at each side of the first connecting seat 53. The two first sleeves 55 are sleeved on the first pin rod 54 and positioned between the two bearing plates 31. In this way, the two first sleeves 55 can limit the first connecting seat 53, thus improving the matching precision of the first connecting seat 53 with the first pin rod 54 and the first connecting plate 42, preventing the first connecting seat 53 from moving along the axial direction of the first pin rod 54, reducing noise and improving transmission precision.

Figure 3:
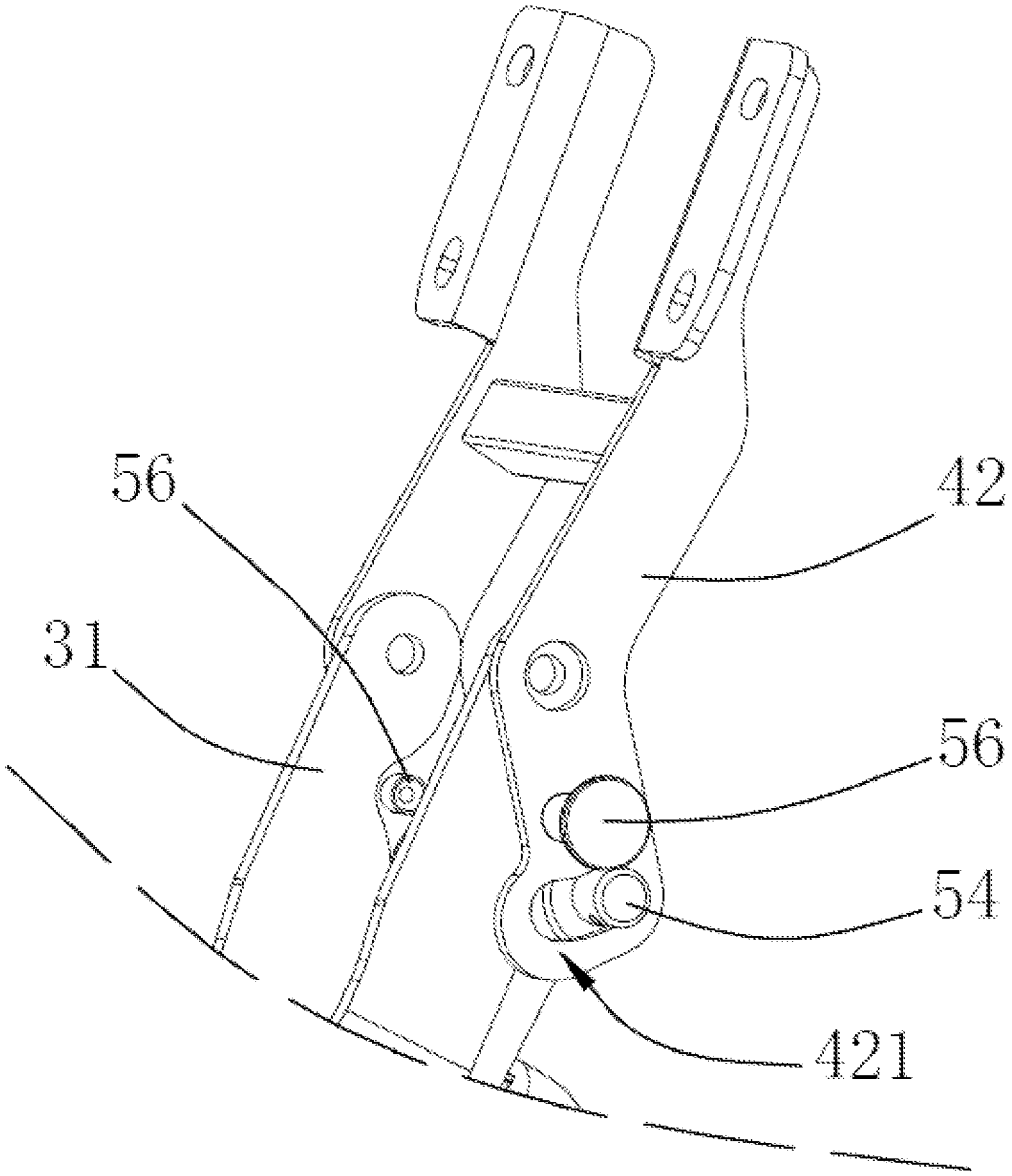
FIG. 3 is a schematic three-dimensional structure diagram according to the present application with showing an arc-shaped hole on a first connecting rod.

Referring to FIGS. 2 and 3, the end of the first connecting plate 42 that is close to the first power module 51 is provided with an arc-shaped hole 421. The center of the arc-shaped hole 421 coincides with an axis at which the first connecting plate 42 is rotatably connected with the bearing plate 31. A first pin rod 54 penetrates through the arc-shaped hole 421 and can slide along the arc-shaped hole 421. A limiting rod 56 is arranged between the first connecting plate 42 and the bearing plate 31. The limiting rod 56 penetrates through the first connecting plate 42 and is close to the arc-shaped hole 421. The two limiting rods 56 extend in opposite directions. When the headrest mechanism 4 is reset, the limiting rod 56 can limit the rotation angle between the headrest mechanism 4 and the bearing support frame 3, thereby preventing the headrest mechanism 4 and the bearing support frame 3 from being excessively rotated and damaged.

Figure 4:
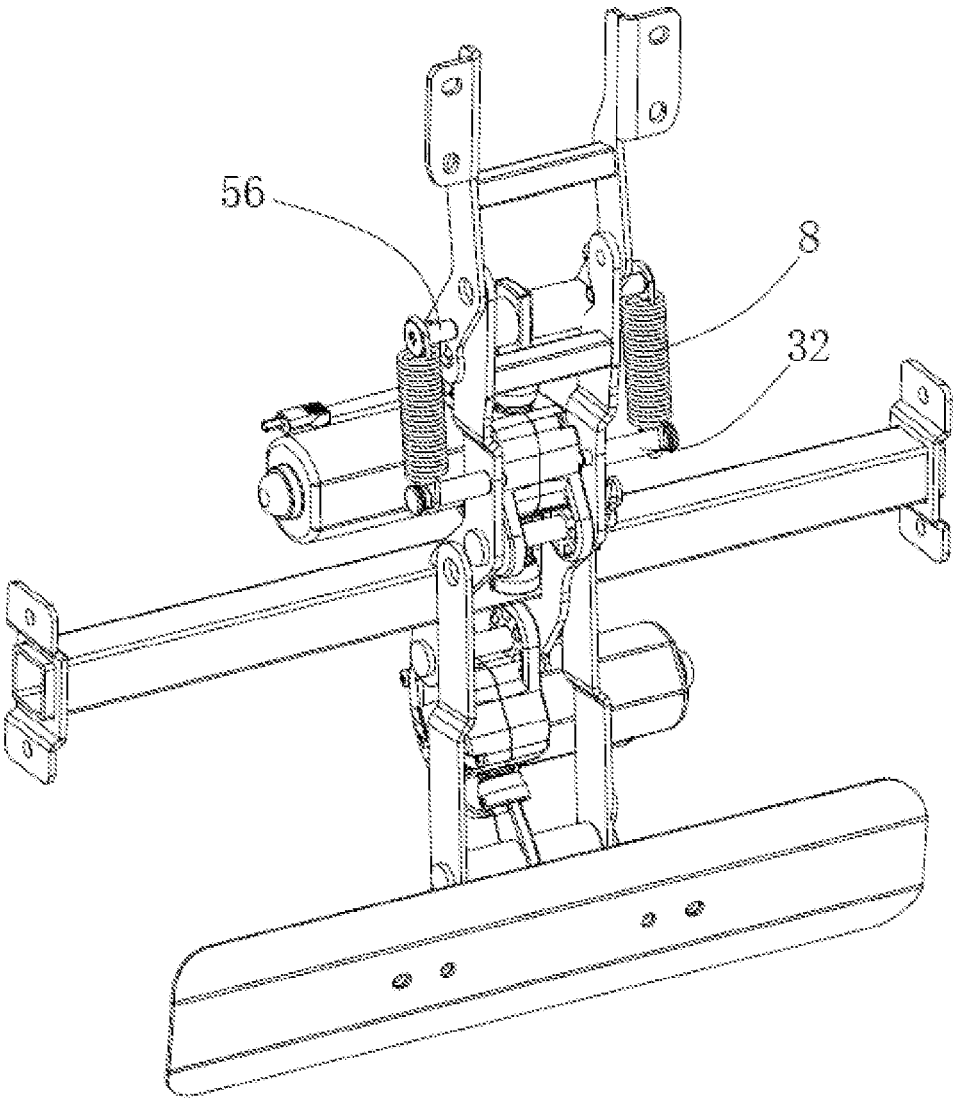
FIG. 4 is a schematic three-dimensional structure diagram according to the present application with showing a connection relationship of a limiting rod, a tension rod and a spring.

Referring to FIGS. 2 and 4, each of two bearing plates 31 are provided with a tension rod 32 that passes through the bearing plate 31. The two tension rods 32 extend in opposite directions. The tension rod 32 and the limiting rod 56 on the same side are connected with each other via a spring 8, so that the limiting rod 56 and the tension rod 32 are tensioned. Under the normal operating condition, when the first transmission lead screw 52 drives the headrest mechanism 4 to rotate, the spring 8 can keep the headrest mechanism 4 in a stable state relative to the bearing plate 31 all the time by virtue of the tensioning effect of the spring 8, so as to reduce the random rotation of the headrest mechanism 4; in addition, during the resetting of the headrest mechanism 4, when a user's or other person's hand is clamped between the headrest mechanism 4 and the frame body 1, due to the presence of the arc-shaped hole 421 in the first connection plate 42, the headrest mechanism 4 has an additional rotational space, and since spring 8 generally has a small elastic force, the occurrence of clamping injury of the hand is reduced.

Figure 5:
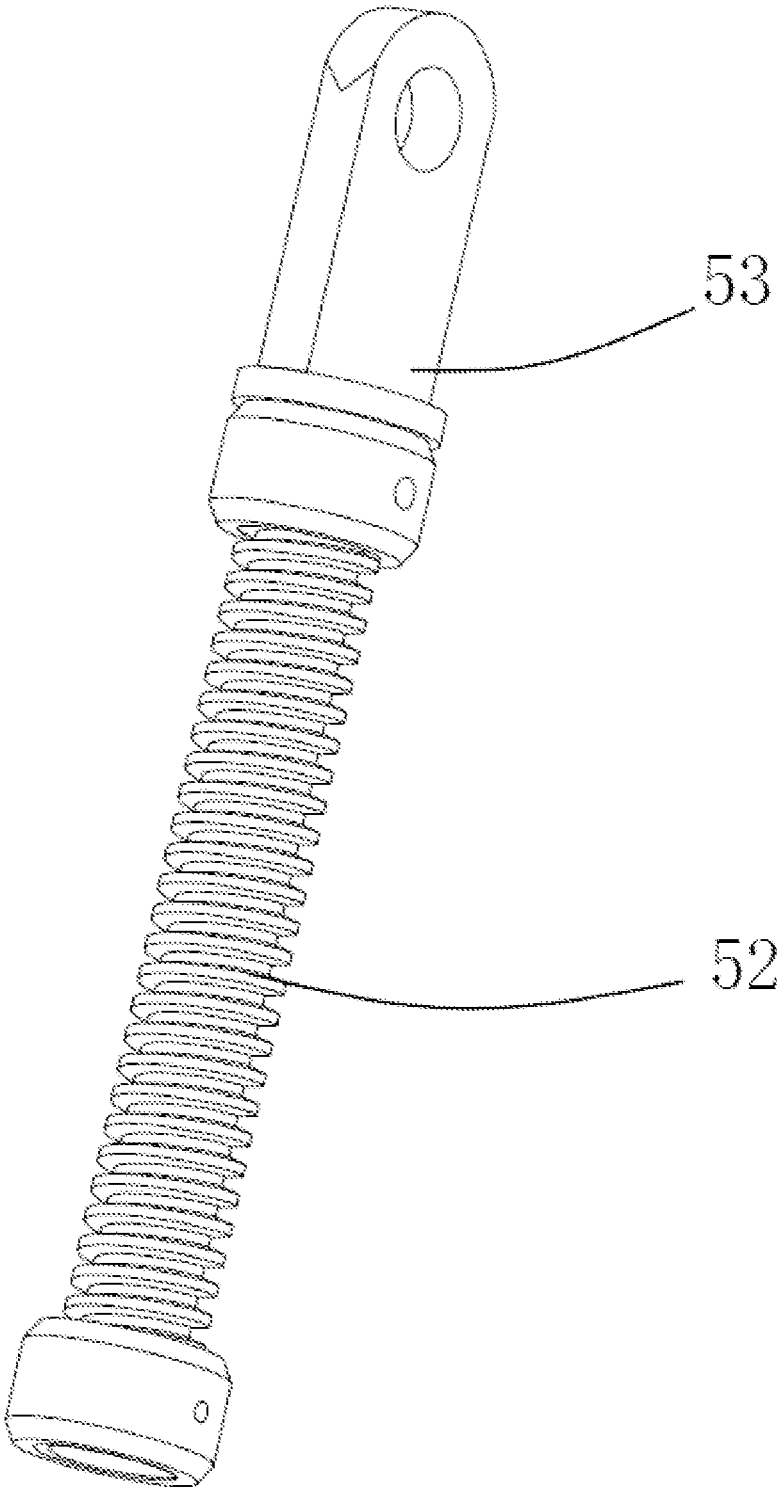
FIG. 5 is a schematic three-dimensional structure diagram according to the present application with showing a first lead screw and a first connecting seat.

Referring to FIGS. 2 and 5, an end of the first connection seat 53 far from the headrest mechanism 4 is cylindrical, and an inner diameter of an end of the cylindrical structure is smaller than an inner diameter of a middle part thereof. A limiting piece matched with the cylindrical structure is fixedly arranged at the end, close to the first connecting seat 53, of the first transmission lead screw 52. The limiting piece is provided in the cylindrical structure, and the diameter of the limiting piece is larger than the inner diameter of the end of the cylindrical structure, so that the first transmission lead screw 52 can pull or push the headrest mechanism 4 to rotate when the first transmission lead screw 52 rotates.

Referring to FIG. 2, the first transmission unit 511 includes a first housing body 5111, the outer surface of which is provided with two connection portions that are hinged to the bearing plate 31. A first worm and a first worm gear, which are engaged with each other, are arranged in the first housing body 5111. The first worm is connected in a transmission manner with a first driving unit 512. The first driving unit 512 can adopt an electric motor known in the prior art, and the axial direction of the first driving unit 512 is arranged to be perpendicular to the supporting plate 11 of the frame body 1. The center of the first worm gear is provided with a first threaded hole. The first transmission lead screw 52 can penetrate through the first housing body 5111 and a first worm gear, and is matched with the first threaded hole so as to drive the first lead screw to rotate when the first worm gear rotates.

In the present application, the first housing body 5111 has a split structure and includes a plurality of housing sections that are assembled and connected by using bolts or the like. When the first transmission screw 52 is damaged due to abrasion after long-term use, it is only required to take the first housing body 5111 apart, so as to detach the first transmission screw 52 from the first transmission unit 511 for replacement. Therefore, the first driving unit 512 and the first transmission unit 511 do not need to be replaced, so that the maintenance cost of the electric sofa is reduced.

Referring to FIGS. 1 and 2, a lumbar cushion mechanism 6 is hinged to the middle part of the bearing support frame 3 and extends to a side far from the headrest mechanism 4. The lumbar cushion mechanism 6 includes a lumbar supporting plate 61. The lumbar supporting plate 61 and the head supporting plate 41 are arranged at the same side of the frame body 1. Two connecting pieces 62 are fixedly arranged on an inner surface of the lumbar supporting plate 61 close to the frame body 1. The two connecting pieces 62 can be fixed with the lumbar supporting plate 61 by screws. The two connecting pieces 62 are each hinged with a second connecting plate 63, and an axis at which the connecting pieces 62 are hinged with the second connecting plates 63 is parallel to the support rod 2. The ends of the second connecting plates 63 close to the headrest mechanism 4 are correspondingly hinged to the middle parts of the two bearing plates 31.

A lumbar cushion driving mechanism 7 is hinged to the end of the bearing support frame 3 close to the lumbar supporting plate 61. The lumbar cushion driving mechanism 7 includes a second power module 71 and a second transmission lead screw 72 that is detachably connected to the second power module 71.

Similar to the structure of the first power module 51, the second power module 71 includes a second transmission unit 711 that is arranged between the two bearing plates 31 in a manner of transmission. The second transmission unit 711 is connected in a transmission manner with a second driving unit 712. A second transmission lead screw 72 penetrates through the second transmission unit 711 and is connected in a transmission manner with the second transmission unit 711. The second transmission unit 711 is hinged to the end of the bearing plate 31 close to the lumbar cushion mechanism 6.

An end of the second driving screw 72 close to the lumbar supporting plate 61 is rotatably connected with a second connecting seat 73. The second connecting seat 73 and the second driving screw 72 are connected in the same manner as that of the first connecting seat 53 and the first driving screw 52. A second pin rod 74 penetrates through the second connecting seat 73, and the second pin rod 74 can penetrate through the two second connecting plates 63 at the same time to realize hinging. The second pin rod 74 is closer to the headrest mechanism 4 than the position at which the connection piece 62 is hinged to the second connection plate 63. A second sleeve 75 may also be further provided on the second pin rod 74 on two sides of the second connecting seat 73. The second sleeve 75 has the same construction and arrangement as the first sleeve 55.

In the present application, the structure of the second driving unit 711 is the same as that of the first driving unit 511, and the structure of the second driving unit 712 is the same as that of the first driving unit 512. The second driving screw 72 and the second driving unit 711 are matched in the same manner as that of the first driving screw 52 and the first driving unit 511. The second transmission unit 711 includes a second housing body 7111 which has a plurality of housing parts. A second worm and a second worm wheel, which are engaged with each other, are arranged in the second housing body 7111. A threaded hole matched with the second transmission lead screw is formed in the middle part of the second worm wheel, and the second transmission lead screw 72 penetrates through the second housing body 7111 and the second worm wheel.

In the lumbar cushion driving mechanism 7, when the second transmission lead screw 72 is damaged due to abrasion, it is only required to detach the second transmission lead screw 72 from the second transmission unit 711 for replacement, and the second transmission unit 711 and the second driving unit 712 do not need to be replaced, thereby reducing the maintenance cost of the electric sofa.

Referring to FIG. 2, in the present application, one end of the first transmission lead screw 52 far from the headrest mechanism 4 may be screwed with a first limiting nut 57, thereby preventing the first transmission lead screw 52 from escaping from the first transmission unit 511 when rotating. One end of the second transmission lead screw 72 far from the lumbar cushion mechanism 6 may be screwed with a second limiting nut 76, thereby preventing the second transmission lead screw 72 from escaping from the second transmission unit 711 when rotating.

The working principle of the sofa backrest adjusting apparatus with integrated headrest and lumbar cushion will be described below.

When a user is sitting on an electric sofa, the first power module 51 can be controlled to operate by using a control element arranged outside the sofa. A first driving unit 512 included in the first power module 51 rotates to drive the first transmission unit 511 to operate, and the first transmission unit 511 drives the first transmission lead screw 52 to rotate and enables the first transmission lead screw 52 to move towards the headrest mechanism 4 along the axial direction of the first transmission lead screw 52. The first driving screw 52 pushes the headrest mechanism 4 to rotate through the first pin rod 54, and the headrest mechanism 4 rotates to a proper angle. When the headrest mechanism 4 needs to be reset, the first driving unit 512 rotates in an opposite direction.

When the user adjusts the lumbar support, the second power module 71 can be controlled to operate through the control element. The second driving unit 712 included in the second power module 71 rotates to drive the second transmission unit 711 to operate, and the second transmission unit 711 drives the second transmission lead screw 72 to rotate and enables the second transmission lead screw 72 to move along an axial direction of the second transmission lead screw 72 towards the lumbar cushion mechanism 6. The second transmission lead screw 72 pushes the lumbar cushion mechanism 6 through the second pin rod 74 to rotate and lift so as to support the lumbar region. Since the lumbar supporting plate 61 is rotatably connected with the second connecting plate 63, the lumbar supporting plate 61 can also be rotated to an angle fit with the lumbar after being lifted to ensure comfort. When the lumbar cushion mechanism 6 is required to be reset, the second driving unit 712 is rotated in the opposite direction.

According to the sofa backrest adjusting apparatus with integrated headrest and lumbar cushion, a large accommodating space is formed in the middle of the frame body 1, and maintenance operation is facilitated. Moreover, when the first transmission lead screw 52 and the second transmission lead screw 72 are worn to be broken, only the corresponding lead screws need to be disassembled and replaced, the first transmission unit 511, the first driving unit 512, the second transmission unit 711 and the second driving unit 712 do not need to be replaced, and the maintenance cost of the electric sofa is reduced.

The above-mentioned preferred embodiments of the present application do not limit the scope of protection of the present application, and therefore: all equivalent variations in the structure, shape, and principles of this application are intended to be within the scope of this application.

Reference numerals: 1. a frame body; 11. a supporting plate; 2. a support rod; 3. a bearing support frame; 31. a bearing plate; 32. a tension rod; 4. a headrest mechanism; 41. a head supporting plate; 42. a first connecting plate; 421. arc-shaped holes; 5. a headrest driving mechanism; 51. a first power module; 511. a first transmission unit; 5111. a first housing body; 512. a first driving unit; 52. a first transmission lead screw; 53. a first connecting seat; 54. a first pin rod; 55. a first sleeve; 56. a limiting rod; 57. a first limiting nut; 6. a lumbar cushion mechanism; 61. a lumbar supporting plate; 62. a connecting piece; 63. a second connecting plate; 7. a lumbar cushion driving mechanism; 71. a second power module; 711. a second transmission unit; 7111. a second housing body; 712. a second driving unit; 72. a second transmission lead screw; 73. a second connecting seat; 74. a second pin rod; 75. a second sleeve; 76. a second limiting nut; 8. a spring.

What is claimed is:

1. A sofa backrest adjusting apparatus with integrated headrest and lumbar cushion, comprising a frame body (1) arranged in a sofa cover, wherein, a support rod (2) is fixedly arranged in a middle part of the frame body (1), and a bearing support frame (3) is fixedly arranged on the support rod (2) along a direction parallel to a length of the frame body (1);

one end of the bearing support frame (3) is rotatably connected with a headrest mechanism (4), a headrest driving mechanism (5) is rotatably connected on the bearing support frame (3) close to the headrest mechanism (4), the headrest driving mechanism (5) comprises a first power module (51) that is detachably connected with a first transmission lead screw (52), one end of the first transmission lead screw (52) is connected with the headrest mechanism (4); when the first transmission lead screw (52) is driven by the first power module (51) to rotate and move along an axial direction of the first transmission lead screw (52), the headrest mechanism (4) is driven to rotate to adjust an angle of supporting for head;

a lumbar cushion mechanism (6) is rotatably connected with a middle part of the bearing support frame (3), the lumbar cushion mechanism (6) extends away from the headrest mechanism (4), an end of the bearing support frame (3), which is away from the headrest mechanism (4), is rotatably connected with a lumbar cushion driving mechanism (7); the lumbar cushion driving mechanism (7) comprises a second power module (71) that is detachably connected with a second transmission lead screw (72), and one end of the second transmission lead screw (72) is connected with the lumbar cushion mechanism (6); when the second transmission lead screw (72) is driven by the second power module (71) to rotate and move along an axial direction of the second transmission lead screw (72), the lumbar cushion mechanism (6) is driven to rotate to adjust support for lumbar.

2. The sofa backrest adjusting apparatus according to claim 1, wherein the frame body (1) comprises two supporting plates (11) arranged in parallel, the bearing support frame (3) comprises two bearing plates (31) that are oppositely arranged and fixedly connected with each other, and surfaces of the bearing plates (31) are parallel to surfaces of the supporting plates (11).

3. The sofa backrest adjusting apparatus according to claim 2, wherein the headrest mechanism (4) comprises two first connecting plates (42) that are oppositely arranged and fixedly connected with each other, and middle parts of the two first connecting plates (42) are correspondingly rotatably connected with ends of the two bearing plates (31) that are far away from the lumbar cushion mechanism (6), ends of the two first connecting plates (42), which are far away from the lumbar cushion mechanism (6), are fixedly provided with a head supporting plate (41);

the first power module (51) comprises a first transmission unit (511) rotatably arranged between the two bearing plates (31), the first transmission unit (511) is connected in a transmission manner with a first driving unit (512), the first transmission lead screw (52) penetrates through the first transmission unit (511), the end of the first transmission lead screw (52), which is close to the headrest mechanism (4), is rotatably connected with a first connecting seat (53), and the first connecting seat (53) is rotatably connected with the end of the first connecting plate (42), which is close to the support rod (2); when the first transmission lead screw (52) is driven by the first driving unit (512) and the first transmission unit (511) to rotate and move along the axial direction, the headrest mechanism (4) is driven to rotate.

4. The sofa backrest adjusting apparatus according to claim 3, wherein the first transmission unit (511) comprises a first housing body (5111) rotatably connected to the bearing plate (31);

a first worm and a first worm wheel, which are engaged with each other, are arranged in the first housing body (5111), the first worm is connected in a transmission manner with the first driving unit (512), a first threaded hole is formed in center of the first worm wheel, and the first transmission lead screw (52) penetrates through the first housing body (5111) and is matched with the first threaded hole.

5. The sofa backrest adjusting apparatus according to claim 3, wherein an arc-shaped hole (421) is formed in one end of the first connecting plate (42) close to the lumbar cushion mechanism (6), and a circle center of the arc-shaped hole (421) coincides with an axis at which the first connecting plate (42) is rotatably connected with the bearing plate (31), the first connecting seat (53) is able to slide along the arc-shaped hole (421);

each of the two first connecting plates (42) is provided with a limiting rod (56) close to the arc-shaped hole (421), the two limiting rods (56) extend away from each other, and the limiting rods (56) is able to limit a relative rotation angle between the first connecting plate (42) and the bearing plate (31); one tension rod (32) is arranged on each of the two bearing plates (31), and the two tension rods (32) extend away from each other;

a spring (8) is connected between a limiting rod (56) and a tension rod (32) on the same side, and the spring (8) tensions the limiting rod (56) and the tension rod (32).

6. The sofa backrest adjusting apparatus according to claim 2, wherein the lumbar cushion mechanism (6) comprises two second connecting plates (63) which are oppositely arranged and fixedly connected with each other, and ends of the two second connecting plates (63), which are close to the headrest mechanism (4), are correspondingly rotatably connected with middle parts of the two bearing plates (31), and ends of the two second connecting plates (63), which are far away from the headrest mechanism (4), are provided with a lumbar supporting plate (61);

the second power module (71) comprises a second transmission unit (711) rotatably arranged between the two bearing plates (31), the second transmission unit (711) is connected in a transmission manner with a second driving unit (712), and the second transmission lead screw (72) penetrates through the second transmission unit (711); an end of the second transmission lead screw (72), which are close to the lumbar cushion mechanism (6), is rotatably connected with a second connecting seat (73), and the second connecting seat (73) is rotatably connected with a position of the second connecting plate (63) close to the lumbar supporting plate (61); when the second transmission lead screw (72) is driven by the second driving unit (712) and the second transmission unit (711) to rotate and move along an axial direction of the second transmission lead screw (72), the lumbar cushion mechanism (6) is driven to rotate.

7. The sofa backrest adjusting apparatus according to claim 6, wherein the second transmission unit (711) comprises a second housing body (7111) rotatably connected to the bearing plate (31);

a second worm and a second worm wheel, which are engaged with each other, are arranged in the second housing body (7111), the second worm is connected in a transmission manner with the second driving unit (712), a second threaded hole is formed in center of the second worm wheel, and the second transmission lead screw (72) penetrates through the second housing body (7111) and is matched with the second threaded hole.

8. The sofa backrest adjusting apparatus according to claim 6, wherein the lumbar supporting plate (61) is rotatably connected to the second connecting plate (63), and an axis at which the lumbar supporting plate (61) is rotatably connected to the second connecting plate (63) parallel to the support rod (2).

9. The sofa backrest adjusting apparatus according to claim 1, wherein an end of the first transmission lead screw (52), which is far from the headrest mechanism (4), is provided with a first limiting nut (57), and the end of the second transmission lead screw (72), which is far from the lumbar cushion mechanism (6), is provided with a second limiting nut (76).

* * * * *